United States Patent [19]

Johnson et al.

[11] Patent Number: 4,508,611

[45] Date of Patent: Apr. 2, 1985

[54] APPARATUS FOR ELECTROPLATING AND CHEMICALLY TREATING THE CONTACT ELEMENTS OF ENCAPSULATED ELECTRONIC COMPONENTS AND LIKE DEVICES

[75] Inventors: Frank Johnson, San Jose; Dieter Reese, Simi Valley; Louis Hirbour, Anaheim, all of Calif.

[73] Assignee: Technic, Inc., Cranston, R.I.

[21] Appl. No.: 462,387

[22] Filed: Jan. 31, 1983

[51] Int. Cl.[3] ..... C25D 17/06; C25D 17/28

[52] U.S. Cl. ..... 204/202; 204/224 R

[58] Field of Search ..... 204/200, 201, 202, 224 R

[56] References Cited

U.S. PATENT DOCUMENTS 4,404,078 9/1983 Francis ..... 204/202

4,425,212 1/1984 Francis ..... 204/202

*Primary Examiner*—Thomas Tufariello

*Attorney, Agent, or Firm*—Seymour Rosenberg; Thomas Gunzler

[57] ABSTRACT

An improved apparatus for the plating of the projecting, bent contact elements of electronic components encapsulated in ceramic packages—suitably of the type known as C-Dips—is provided with a continuous flexible conveyor belt of stainless steel running in a vertically aligned loop with a web of the belt horizontal. The edges of the belt are bevelled to receive, pressed thereover, a gap between the ceramic package and the selvedge associated with the untrimmed lead frame of the contact elements in a frictional, reversible grip. The parts to be plated are forced onto the edge of the intermittently moving belt during its period of rest, and are carried through the treatment stations of the plating apparatus as the belt progresses from a loading station towards an unload station, after the parts have been plated, where the individual encapsulated electronic components are stripped from the belt into receiving trays or magazines.

15 Claims, 14 Drawing Figures

Fig.1.
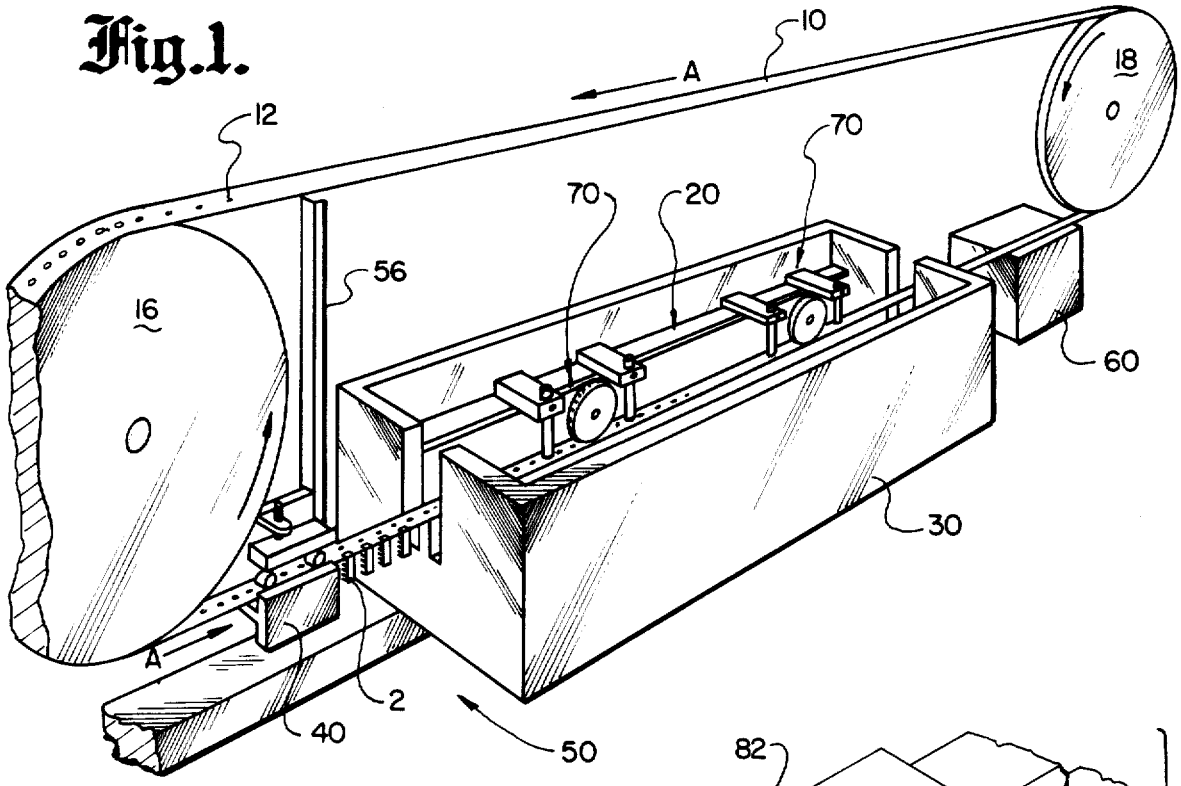
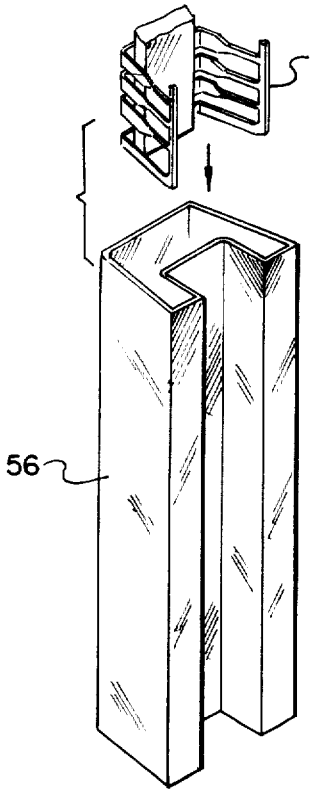
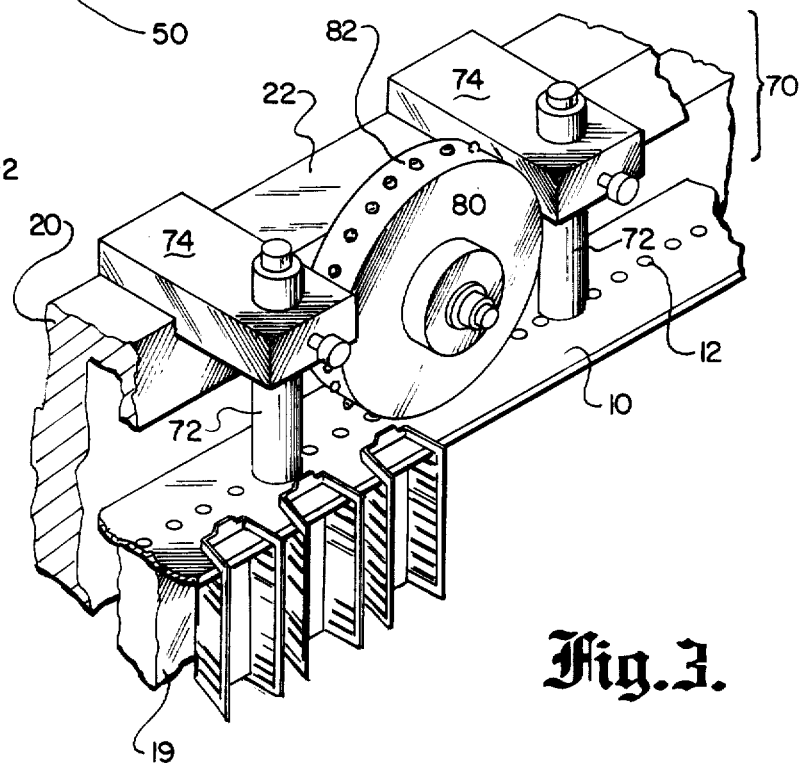
Fig.3.
Fig.2.

Fig.4.A.
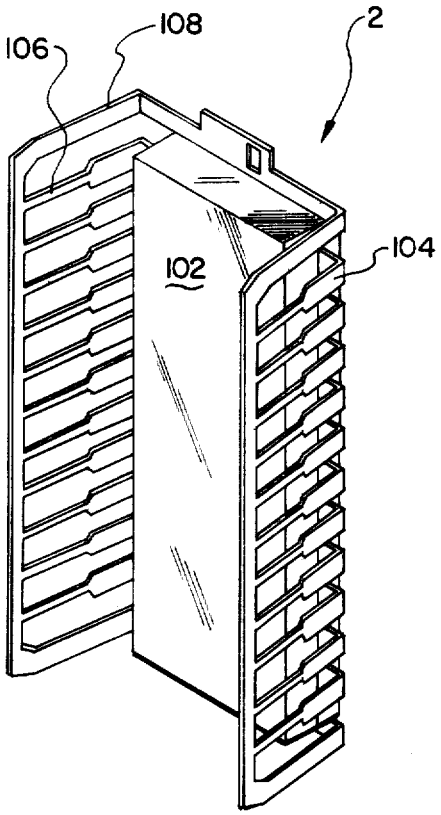
Fig.4.B.
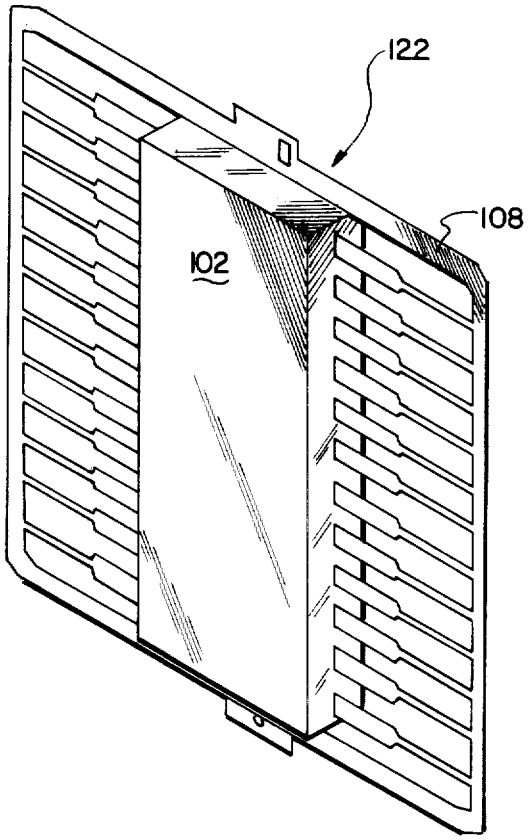
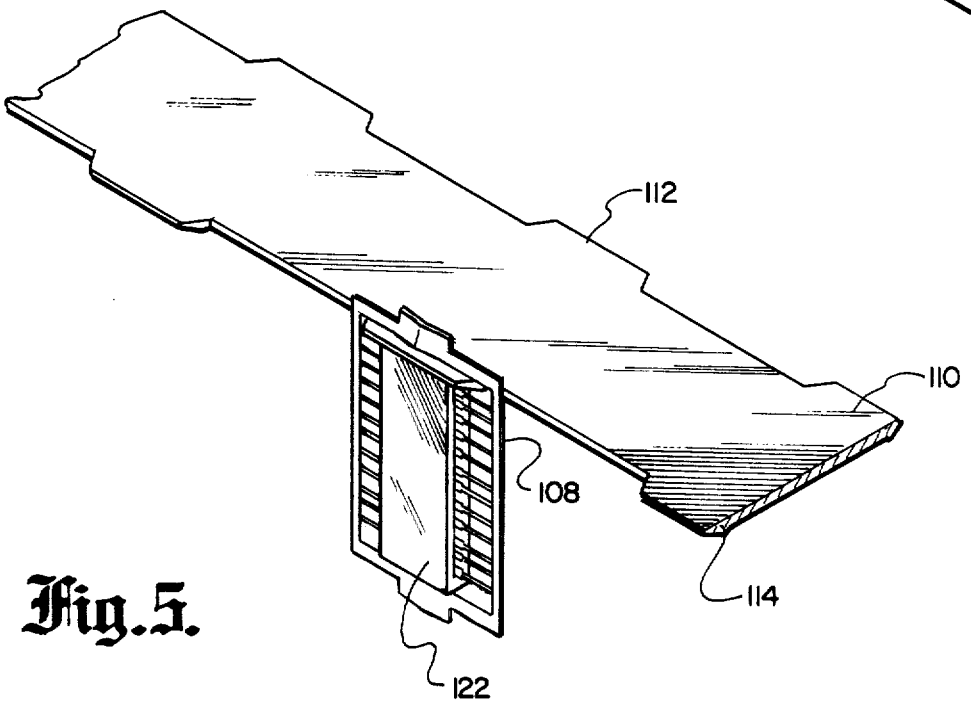
Fig.5.

APPARATUS FOR ELECTROPLATING AND CHEMICALLY TREATING THE CONTACT ELEMENTS OF ENCAPSULATED ELECTRONIC COMPONENTS AND LIKE DEVICES

BACKGROUND OF THE INVENTION

The invention relates to apparatus for electroplating the contact elements of encapsulated electronic components and their like; it relates, more particularly, to apparatus provided with a flexible, continuous, electrically conductive conveyor belt with edges configured to engage and hold such encapsulated electronic components and carry them through the treatment stations of the apparatus associated with the plating or treating process.

In the field of electronics it has been known for some time that it is advantageous to manufacture discrete or integrated circuit elements in such a manner that the active portions of such elements are encapsulated in a ceramic slip—which is subsequently fired—with only passive contact elements protruding through the ceramic sheath so formed. In general the contact elements for such employment are stamped from a panel of sheet metal and contain internal connectors to the active electronic components as well as the protruding contacts destined to allow the circuit element—or chip, in some cases—to be connected into the appropriate electronic network. In many instances the process of manufacture of the lead frame will provide a selvedge to which all, or most, of the protruding contact elements are still attached prior to the plating operation and serving as a stiffening and handling frame until trimmed away in a final manufacturing step.

The protruding contact elements of the encapsulated electronic components frequently require the deposition of a different metal than the alloy of the metal panel from which they are formed, so as to permit the ready interconnection of the contacts by means of soldering, or, in some cases, for the sake of corrosion protection or other purpose.

The most commonly used metallic coatings applied by means electrodeposition are tin—for facilitating soldering—and silver or gold—where the contacts are used in a frictional mode and it desirable to enhance contact conductance. Where the underlying contact elements are made from an iron-based alloy, it is frequently coated with a thin 'flash' of copper before the application of the desired surfacing material.

THE PRIOR ART

The prior art relies predominantly on plating processes involving the manual loading of encapsulated electronic components onto plating racks or into plating baskets—constructed from electrically conductive materials—and sequentially submerging the plating racks, or baskets, into tanks filled with various cleansing and treatment solutions prepartory, and in some instances following, their immersion into a liquid electrolyte and interconnection with the plating circuit. Alternately, encapsulated electronic components may also be subjected to barrel plating techniques for the electrodeposition of a metallic coat on their contact elements.

Such 'rack plating' and 'barrel plating' techniques are, however, not well suited for the preparation of plated contacts on encapsulated electronic compoennts for a number of reasons:

the parts to be plated are small and, generally, extremely fragile—leading to high rates of mechanical damage in the various manual handling and transfer steps in the processes commonly employed;

the deposition of the plating alloy is poorly controlled, so that close tolerances on the uniformity and thickness of the deposited material—frequently called for in the case of the contact elements of encapsulated electronic components—are difficult to meet; and as a combination of the above effects, and the relatively poor control of the residence time of the parts being treated in chemically active solutions, a relatively large rate of rejects is experienced with, frequently expensive, components nearing the end of their manufacturing process, causing a severe economic burden.

The prior art also contains devices which convey parts undergoing electroplating through a series of treatment stations by means of conveyors or rails. Such developments of the prior art are found in U.S. Patents to CURTIS (U.S. Pat. No. 2,626-621), REID (U.S. Pat. No. 3,066,091), GRIMALDI et al (U.S. Pat. No. 3,878,062), WELTER (U.S. Pat. No. 3,649,507), and to HELDER et al (U.S. Pat. No. 4,032,414). The devices and processes disclosed in these writings of the prior art failed to cure the problems encountered in the electroplating of contact elements of encapsulated electronic components and found no acceptance in the practice of the art.

OBJECTS OF THE INVENTION

The principal object of the invention is to teach the construction of apparatus for the electroplating of contact elements projecting from encapsulated electronic components, wherein the encapsulated components are carried through the treatment stations—including the principal plating bath or baths—by means of a continuous, flexible conveyor belt constructed from an electrically conductive material, with the conveyor acting as one of the electrodes of the plating current supply circuit.

It is another object of the invention to teach the construction of continuous, flexible conveyor belts with edge treatments designed for the ready engagement of encapsulated electronic component lead frames in a manner ensuring safe retention and good electrical conductive contact between the belt and parts so engaged therewith.

It is a further object of the invention to provide plating apparatus adapted to carry out all of the plating and ancillary treatment processes, to which the contact elements are to be subjected, in a single passage of the aforementioned conveyor belt through the apparatus, with provisions for automatically loading encapsulated electronic components onto the edges of the conveyor and automatically disengaging such components after the completion of the plating process, so as to minimize manual handling or mechanical manipulation of such parts.

It is a particular objective of the invention to provide plating apparatus adapted to to the electrodeposition of metallic coatings to the contact elements of encapsulated electronic components commonly known as C-dips, wherein the active portions of such components are ensheathed in a chemically and electrically inert ceramic material.

It is yet another object of the invention to teach the construction of plating apparatus as hereinabove described. which are capable of uniformly and reliably plating the projecting contact elements of ceramic-encapsulated electronic components, and their like, with a minimum of mechanical or chemical damage and at an economic cost.

It is also an object of the invention to provide apparatus of the character described above which is adaptable to treatment processes operating on the contact elements of encapsulated electronic components—and other devices and hardware utilized in the elctronic arts—which may be described by the generic term of chemical processing. Such chemical processing is understood to encompass, among others, electroless plating, immersion plating, electroplating, as well as surface treatments, such as phosphating and oxidizing processes, for example.

SUMMARY OF THE INVENTION

The above objects of the invention—and other objects and advantages associated therewith, which shall become apparent from the detailed description of the preferred embodiment hereinbelow—are attained in a device which incorporates an endless, flexible, flat conveyor belt propelled in a continuous loop in vertical alignment. The belt is constructed from an electrically conductive material—suitably a stainless steel alloy—shaped into a belt with a flat web, held substantially horizontal in its main passage through the apparatus; of minimal thickness consistent with the demands of mechanical strength and flexural longevity.

One edge, or both, of the conveyor belt is developed—by bevelling, sculpturing, bending or other means which would not materially affect the bendability of the web—to engage some portion of the contact element array of the encapsulated component which is to be plated in the apparatus. Such engagement must be reversible and must develop sufficient holding strength to permit the safe traverse of the part, while carried by the conveyor belt, through the treatment solutions of the plating apparatus.

Parts are dispensed from trays or magazines, as appropriate for particular shapes and sizes, and engaged to the edge of the conveyor belt by means of automatic servo-mechanisms in the feed station, or stations, under computer control in the preferred mode of employment. Unloading stations are also foreseen, automatically stripping plated parts from the conveyor belt and depositing them in appropriate trays or magazines. Depending on the nature of the parts and their method of engagement with the conveyor, the unloading mechanism may be automated or rely on passive displacement strippers.

Generally, the plating apparatus of the invention will subject the parts—in their travel with the conveyor belt—to a number of preparatory treatments. In such treatments the surfaces to be plated are cleansed and activated, to ensure optimal conditions for the electrodeposition process. The parts may pass through one electrolytic bath, or more, depending on the nature of the coating, or coatings, to be applied, their thickness and other desiderata as known in the plating arts. In the plating stations of the apparatus the parts become connected to the direct-current supply energizing the electroplating process via electrodes in contact with the web of the conveyor belt. The belt, and the conductive portions of the electronic components engaged therewith, form the cathode of the plating circuit; the anode is conventionally developed by anode bars submerged in the electrolyte.

To ensure the wetting of the contact elements engaged onto the conveyor belt which are to be plated, the tanks holding the plating solution, and other treatment solutions disposed along the path of the conveyor, are provided with entrance and exit weirs through which the belt enters the tanks at, or below, the level of the fluid therein, ensuring the full submergence of the parts to be plated in the fluid. To receive the overflow from the weirs, the actual treatment fluid tanks are surrounded by receptacles for the overflow, with the receptacles connected to storage containers for the specific fluid. The treatment fluid is then pumped from the storage container back into the treatment tank, to replenish the material therein. The pumping action also serves to stir and, consequently, maintain the chemical uniformity of the treatment fluid.

The provision of such weirs permits the active portion of the conveyor belt to run in a continuous, horizontal alignment, while providing for the full submersion of the parts in all the treatment fluid tanks without any vertical displacement of the parts.

The drive of the conveyor belt may be at uniform speed, at variable—suitably cyclic—speeds, or may be intermittent. The factors determining the manner in which the conveyor advances depends on the nature of the loading and unloading devices employed, as well as on the most suitable condition for the plating process itself. In some instances a period of rest in the plating bath may be desirable, in others a continuous passage through the plating tank may provide a more uniform deposit of metallic film. Intermittent motion of the conveyor belt may be highly desirable where the loading, or unloading, servomechanism has to perform a complex series of movements in engaging the parts to be plated with the belt, due to the absence of relative motion between the components.

It is also foreseen that separate controller means, a digital micro-processor for example, might be employed to govern the motion of the conveyor belt and to synchronize the operation of loading and unloading stations for working parts with that motion. The function of such controller means may further extend to monitoring the properties of the plating baths, or even of the metal coatings applied in the baths, and adjusting the operating characteristics of the plating current circuit to such varying conditions as may be sensed to assure the uniformity of the electrochemical processes within the apparatus.

The preferred mode of utilization of the apparatus of the invention is in electroplating, and the detailed description of the preferred embodiment, hereinbelow, relates to apparatus dedicated to the electrodeposition of metallic substances and to ancillary treatment processes associated with that object. The apparatus of the invention can also be employed in other modes, to carry out surface treatments—chemically or electrochemically—on the contact elements of encapsulated electronic components and their like. Such surface treatments may include the electroless deposition of metals, immersion plating, electropolishing, oxidizing and phosphating processes, etc. The nature of such processes require that the parts be immersed in a liquid medium under controlled conditions and for specified times, and will, in general, call for a series of preparatory treatments and finishing rinses analogous to the processes associated with electroplating.

BRIEF DESCRIPTION OF THE ACCOMPANYING DRAWING

The preferred embodiment of the invention will be described hereinbelow with reference to the accompanying drawing, wherein:

FIG. 1 is a perspective view of a simplified plating device constructed according to the teachings of the invention with a continuous, electrically conductive conveyor belt and a single plating station;

FIG. 2 is a partial, perspective view of a magazine for typical, encapsulated electronic components with contact elements suited for plating in the apparatus of the invention;

FIG. 3 is a partial, perspective view of the conveyor belt of the embodiment of FIG. 1, passing through the plating bath thereof;

FIG. 4A is a perspective view of a typical encapsulated electronic component, similar to that shown in FIG. 2;

FIG. 4B is a perspective view of another typical, encapsulated electronic compoent, with contact elements planarly aligned with the encapsulated portion thereof;

FIG. 5 is a partial, perspective view of a conveyor belt adapted to engage and transport the electronic component of FIG. 4B;

FIG. 10 is a transverse section through a plating station of typical electrodeposition apparatus constructed according to the invention;

DESCRIPTION OF THE PREFERRED EMBODIMENT

Figure 6:
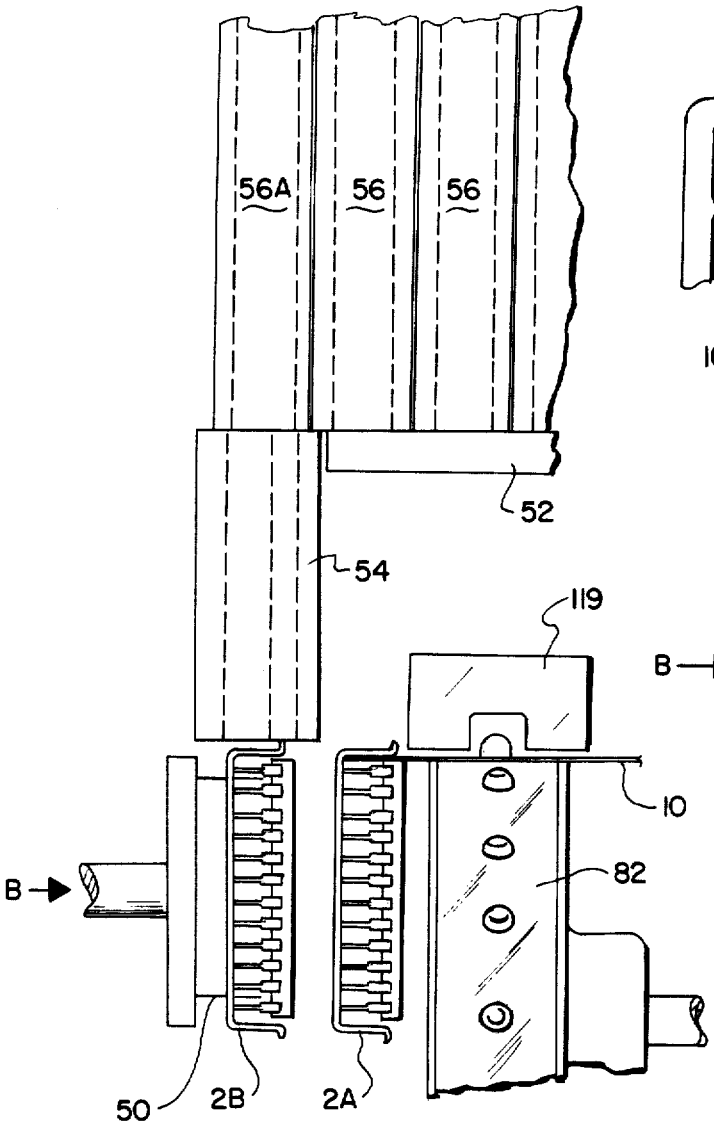
FIG. 6 is a partial end view of the loading station of the plating apparatus shown in FIG. 1.

The perspective view of FIG. 1 depicts a simple plating device demonstrating the principal features of the invention, with a conveyor belt 10 for encapsulated electronic components 2 passing through a plating tank 20. The conveyor belt 10 is a thin web of stainless steel with equally spaced perforations 12 piercing its longitudinal centerline for engagement by projecting pins on a drive wheel 18 and an idler wheel 16. The drive wheel 18 is driven, by apparatus not visible in the view, in an intermittent, stop/go manner and coacts with a servomechanism at a feed station 50 to place parts 2 onto the edge of the conveyor 10 during the stationary periods of the conveyor. In the view of FIG. 1, the feed mechanism at station 50 is not visible, being hidden behind a belt tensioning device 40. The feed station strips individual parts from a magazine 56 and engages them on the edge of the belt 10.

The plating tank 20 is surrounded by a receptacle 30 for the overflow of the electrolyte contained within the tank and replenished from a circulating fluid system to be more fully described with reference to FIG. 11, below. Superposed on the belt 10, within the plating station associated with the tank 20 there are two brush units 70, representing the cathode connection of the plating current supply system.

Parts which have passed through the plating process in tank 20, are stripped from the conveyor belt 10 at an unload station 60, before the belt decision—in the sense of arrows 'A'—is reversed over the drive wheel 18.

The partial perspective view of FIG. 2 depicts a magazine 56 with a portion of a workpiece 20 about to be placed thereinto. The magazine 56 is a thin-walled plastic tube of constant section in which the parts 2 slide freely along the axial dimension. In general, the use of magazine 56 is fairly wide-spread in the field of manufacturing, storing, shipping and handling encapsulated electronic components typified by the parts 2 and the technology of loading them into magazines 56—and, concomitantly, the means for unloading them from the magazines—in a careful manner using automated equipment is fairly well developed.

FIG. 3 is a fragmentary, perspective view of a brush unit 70 as incorporated into the embodiment of FIG. 1. The belt 10 runs over a support block 9 with its web horizontal. The conveyor 10, the principal parts carrier of the plating apparatus of the invention, is stabilized against whipping and buckling by means of an idler sprocket provided with engagement buttons 82 cooperating with the orifices 12 in the centerline of the belt 10. Two electrical contact bars 72, supported in brush-holders 74 mounted to a rim 22 associated with the tank 20, are adjusted to slide over the upper surface of the belt flanking the sprocket 82. The cathode current from the direct-current supply of the plating station is transferred from the contact bars 72 to the belt 10, and, thence, to the parts 2 which are engaged at the edge of the conveyor. In the illustration of FIG. 3, such parts 2 are only shown on one side of the belt and along a short portion of the belt 10—in actual use such parts would be loaded, in the preferred mode of carrying out the invention, along both edges of the belt in a continuous, close array.

The perspective view of FIG. 4A is a large-scale depiction of a typical part 2 whose contact elements 104 issue from a ceramic-covered central body 102. The contact tines 104 terminate in reduced-width prongs 106 which, in turn, are attached to a peripheral frame 108. The frame 108 constitutes a selvedge of the sheet-metal panel from which the contact tines 104/106, as well as the connecting portion within the capsule 102, had been stamped and will, in a subsequent trimming operation, be removed so as to leave the individual prongs 106 as free-standing contact elements. In the part 2, the arrays of tines 104 issuing from each longitudinal edge of the capsule 102 have been bent in a manufacturing step following the encapsulation of the electronic components of the device.

FIG. 4B is a view similar to that of FIG. 4B, showing a part 122, which corresponds, in all essentials, to the part 2 prior to the bending of the array of contact tines 104. The part 122 still retains the selvedge 108 and represents a typical electronic component as may be supplied for the electroplating of metallic materials onto the associated contact element array.

FIG. 5 is a perspective, fragmentary view of a conveyor belt 110 with lateral tabs 112 projecting from its edges, at intervals commensurate with the suspension of frames 108 of parts 122 therefrom. The tabs 112 are bevelled on the distal side of the belt 10 at locations 114, to aid in the engagement of the parts 122 with the edges of the belt 110. Due to the relative shortness of the tabs 112, the flexibility of the belt 110 is not materially varied over its length, and the drive mechanism of the embodiment of FIG. 1 would be suitable for its propulsion.

FIG. 6 is a partial end view of loading station 50, as utilized in the embodiment of FIG. 1 or in similar plating apparatus built in accord with the invention. It shows a number of magazines 56 supported in rack 52 and charged with parts 2 to be plated. A particular magazine 56A is in the feed position atop a chute 54, through which parts 2 are delivered to a feed ram 58—forming part of the servo-mechanism utilized to load components onto the conveyor belt 10—with a particular part 2B shown entrained on the arm 58 and ready to advance towards the apposite edge of the belt 10. The belt 10 is shown stabilized and accurately located for loading apparatus by means of a idle sprocket 82 and a support bar 119; part 2A is shown engaged to the edge of the belt 10 in a previous feed operation of the ram 58. In the case of loading devices of the type depicted in FIG. 6, the drive of the belt 10 is advantageously of the intermittent motion type, so that the advance stroke of the ram 58 would coincide with the stationary period of the belt traverse.

Figure 7:
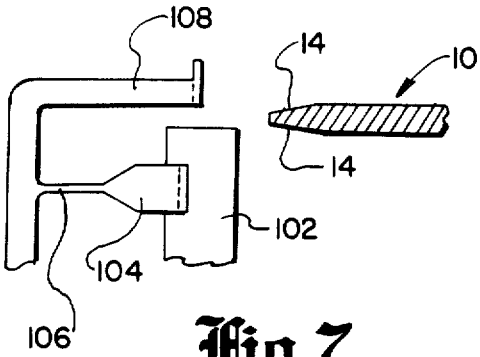
FIG. 7 is a partial section through the conveyor belt of the embodiemtn of FIG. 1, adapted to receive and engage encapsulated electronic components of the type shown in FIG. 4A.

FIG. 7 is a fragmentary detail of the relative positions of the edge of the belt 10, bevelled on both the upper and distal surfaces at locations 14 to assist in the engagement of parts 2 with the belt, and the upper portion of a typical part 2 prior to the lateral travel of the latter into engagement with the belt edge.

Figure 8:
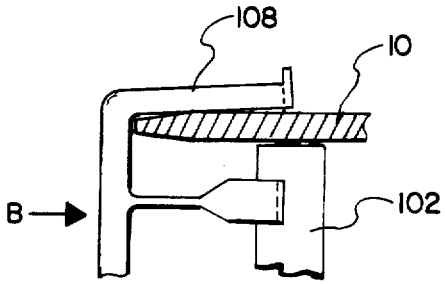
FIG. 8 is a view similar to FIG. 7, with the component shown engaged onto the edge of the conveyor belt.

FIG. 8 is a view similar to that of FIG. 7, showing the interaction of the belt 10 with the body 102 and selvedge 108 of the part 2, after the latter has been engaged thereon. The part is firmly held in position by a slight deformation of the frame 108, facilitated by the ramp action of the bevel 14 of the belt edge.

Figure 9:
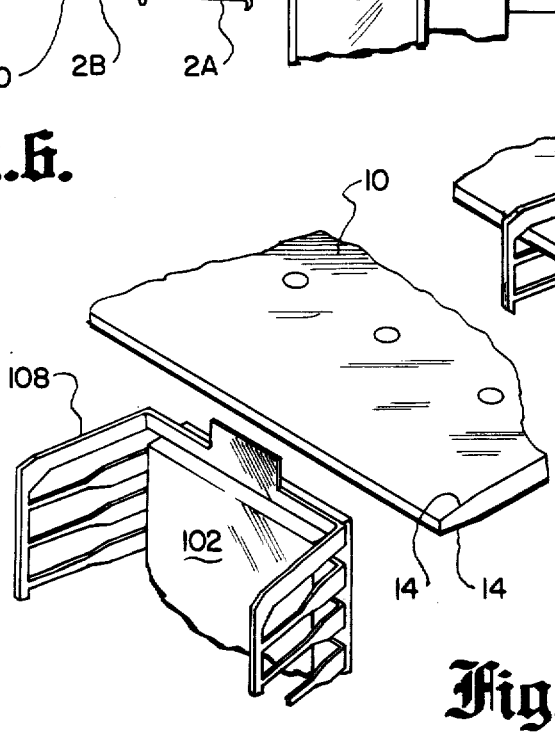
FIG. 9 is a fragmentary, perspective view of an encapsulated electronic component juxtaposed with the bevelled edge of a conveyor belt prior to engagement thereon.
Figure 10:
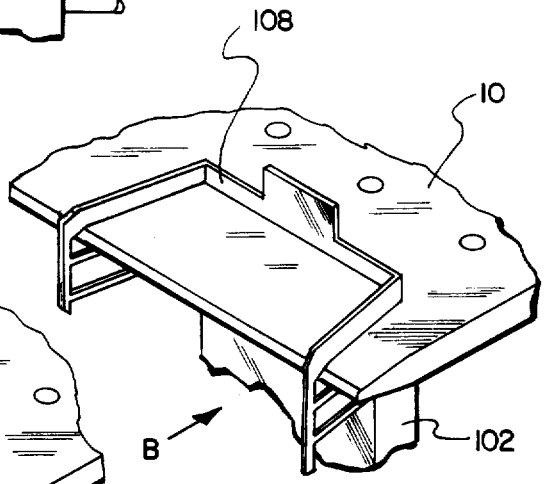
FIG. 10 is a perspective view similar to that of FIG. 9, with the encapsulated electronic components fully engaged on the conveyor belt in a condition corresponding to the cross-sectional view of FIG. 8.

FIGS. 9 and 10 are perspective view corresponding to the transverse sections of FIGS. 7 and 8, respectively. FIG. 9 illustrates the relative positions of the belt 10 and of the part 2 prior to engagement, such engagement being secured by the action of ram 58, or its analogue in a mechanically different loading device, causing the part to be advanced, in the direction of arrow 'B', into frictional engagement over the co-operating, bevelled edge of the conveyor belt 10. The position of the encapsulated electronic device is shown in FIG. 10 at the end of the loading sequence, with selvedge 108 looped over the upper surface of the conveyor belt 10.

Figure 11:
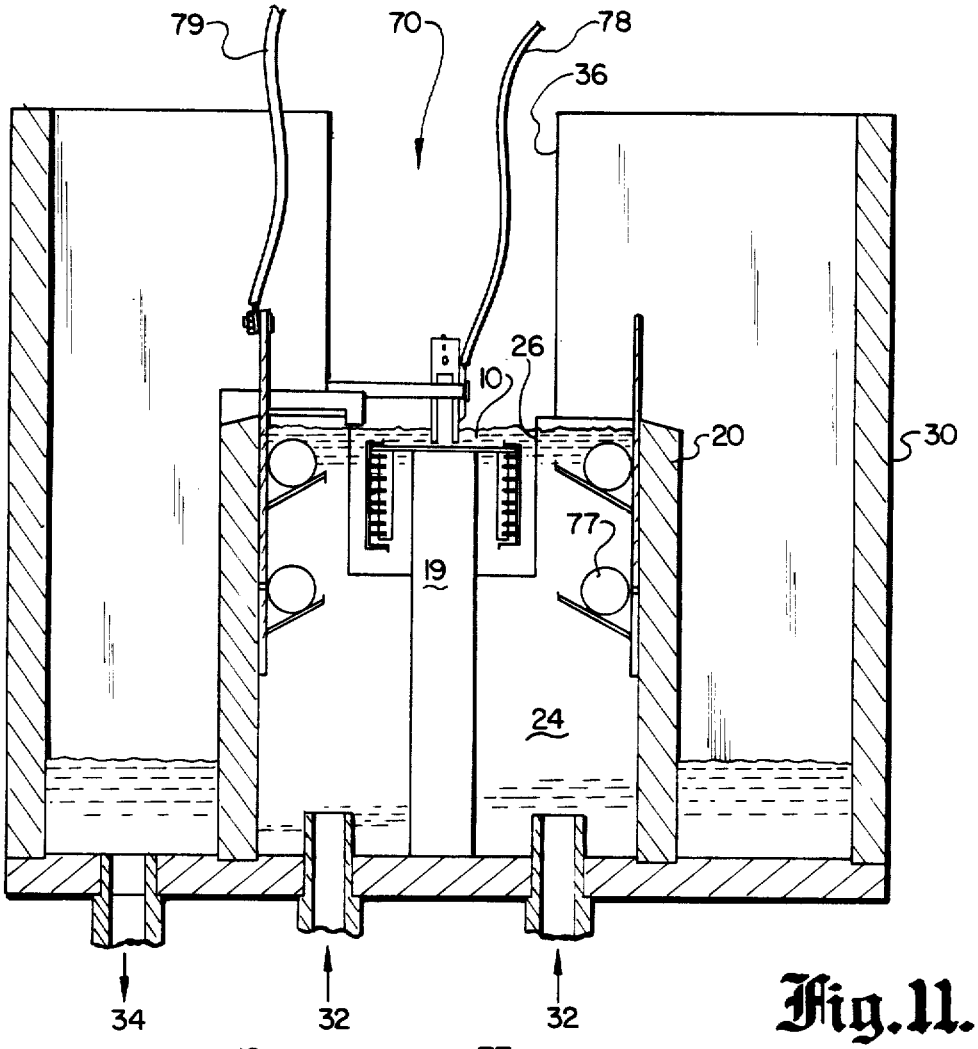

FIG. 11 is a transverse section through a typical plating station employed in the electroplating apparatus of the invention. An electrolyte tank 20 contains liquid electrolyte mass 24 and is surrounded by receptacle 10. The receptacle 30 receives fluid electrolyte overflowing from the bath 24 through weirs 26 at opposing ends of the tank 20, in line with the run of the conveyor belt 10. The weirs 26, and corresponding weirs 36 in the ends of the receptacle 30, admit the belt and the parts 2 suspended from it at an elevation which lies below the level of liquid electrolyte in the tank 20.

Electrolyte overflowing from the tank 20 into the receptacle 30 drains through discharge orifice 34, and is returned—by means of a circulating pump—to the interior of the tank 20 through supply orifices 32. The electrolytic bath 24 encompasses the run of conveyor belt 10, with parts 2 depending from its edges, and permits the flow of metal ions from anode bars 77 to the contact elements of parts 2 which are to be plated.

Cathode connection to the belt and its engaged parts is provided by contact assembly 70, via a cable 78. The corresponding anode connection is made via cable strap 79 to the rack on which the anode bars rest.

Figure 12:
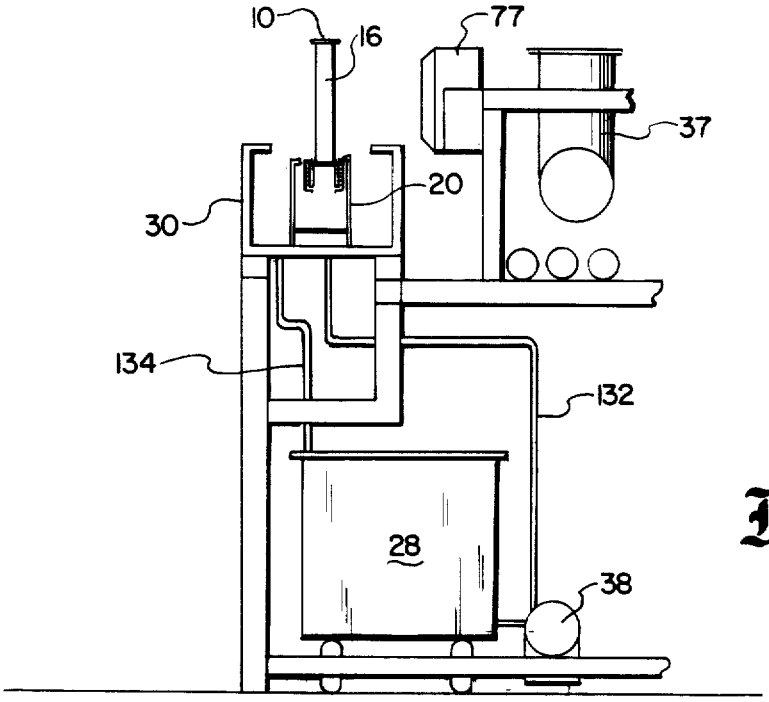
FIG. 12 is a transverse section through the plating apparatus of the invention.

FIG. 12 is a transverse section through electroplating apparatus incorporating a plating station similar to that shown in FIG. 11. The conveyor belt 10 passes over idler wheel 16 and traverses the plating tank 20 and its surrounding receptacle 30. Electrolyte draining from the receptacle 30 is carried by conduit 34 into a container 28, whence it is returned by a circulating pump 38 to the tank 20, via conduit 132. The apparatus also encompasses auxiliary equipment, such as direct-current source 77, for energizing the plating circuit through cables 78 and 79, and exhaust duct 37, through which environmentally harmful vapors are withdrawn from the vicinity of the treatment tanks.

Figure 13:
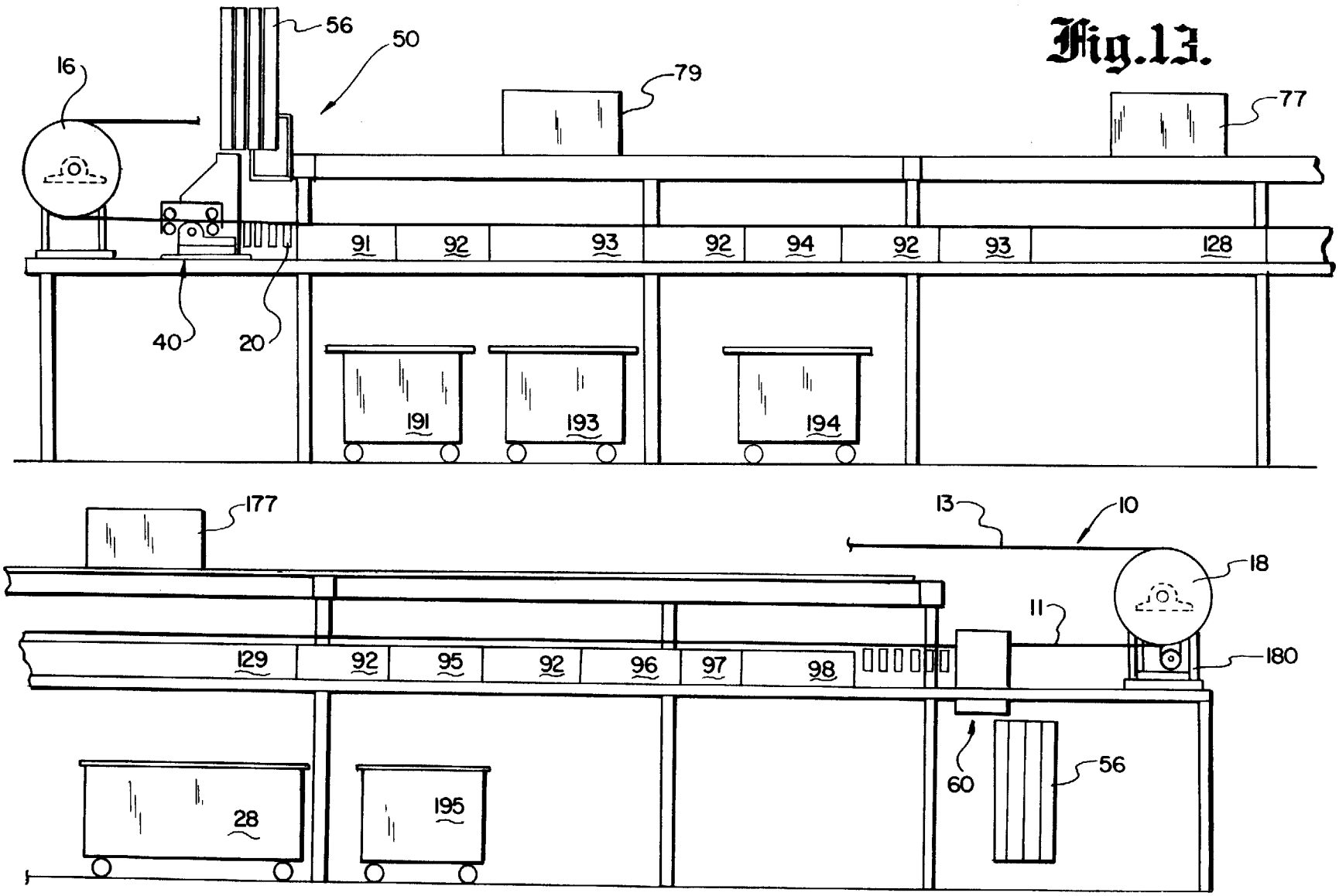
FIG. 13 is a frontal elevation of plating apparatus in accord with the teachings herein.

FIG. 13 is an overall view, in frontal elevation, of a plating line for tin-plating the contact elements of workpieces, such as parts 2 or 122. The plating line employs a flexible conveyor belt 10—with forward run 11 and return run 13 superposed in a vertically aligned loop—drawn through the treatment stations by means of drive wheel 18 with its associated drive motor 180. The loop is completed by idler wheel 16. The conveyor belt is tensioned by controller 40 and parts are engaged onto the belt by means of a loading device 50, from magazines 56. The belt 10 carries the parts 2 into a series of treatment stations, generally similar to the plating station depicted in FIG. 11 in the case of liquid treatment media.

In the particular plating apparatus of FIG. 13, the parts first enter a treatment station 91 where they are exposed to a nitric acid etching bath, with the etchant supplied from a container 191 by means of a circulating pump. The parts are next rinsed in tapwater in the tank of a treatment station 92; being carried, thereafter, into a tank filled with a 10% solution of sulphuric acid in treatment station 93. The dilute acid solution is stored in, and circulated from, a container 193.

The parts are washed again in a station 92, and pass into treatment station 94 filled with a bright dip solution, supplied from container 194. The parts are rinsed again in a station and exposed to dilute sulphuric acid in another station 93. While in the sulphuric acid baths, the parts are exposed to a current supplied from rectifier 79.

The preparatory treatments having cleansed and activated the metal surfaces to be plated, the parts 2 are carried into plating stations 128 and 129 in succession where they are exposed to the plating circuits powered from DC sources 77 and 177, respectively, and submerged in electrolyte from tank 28. The contact elements of the parts 2 are tin plated in stations 128 and 129 to facilitate their attachment by soldering to other components in an electronic circuit.

The parts next pass through another water rinse station 92 and through a neutralizer solution provided from container 195 to treatment station 95. Another rinsing in tapwater in station 92, exposure to de-ionized water in station 96 and to cool and hot air streams, respectively, in stations 97 and 98 complete the plating process for parts 2.

The parts, now with plated contact elements, are carried into an unloading station 60 at this point, where they are stripped from the conveyor belt 10 and deposited in magazines 56 for removal to subsequent manufacturing or processing operations. In its simplest form the unloading station 60 comprises outwardly tending cam surfaces overlying the run 11 of the conveyor 10 in such a manner that parts 2 are pushed laterally off the edge of the belt 10 and drop into chutes conveying them to the magazines 56.

The foregoing description of the preferred embodiment of the invention encompasses only two of the variant embodiments of the conveyor belt; others may suggest themselves to those skilled in the art, to adapt the conveyor edge treatment to the engagement of encapsulated electronic parts and their like. Such variations, and other detail changes in the apparatus of the invention, are deemed to be encompassed by the disclosure herein, the scope of the invention being solely limited by the appended claims.

I claim:

1. Improved apparatus for electroplating projecting contact elements of encapsulated electronic components, and their like, comprising:

a continuous, flexible conveyor belt of electrically conductive material;

guide means for said conveyor belt, constraining the motion thereof into a closed loop defined by a substantially vertical plane, with the web of said conveyor belt in substantially horizontal alignment;

passive engagement means defined by wedge-shaped edges of said conveyor belt for the frictionally-secured reception of portions of said components thereon;

drive means for said conveyor belt;

at least one tank for liquid electrolyte disposed along the path of said conveyor belt, said tank being provided with weirs in its upper edge adapted to pass the conveyor belt and components engaged thereon inwardly and outwardly of the liquid mass contained in said tank; and electroplating current supply means, including at least one electrode disposed within the liquid volume of said container and at least one current transfer brush in contact with said conveyor belt, for supplying plating current for the deposition of a metallic substance from said electrolyte onto said contact elements.

2. The apparatus of claim 1, wherein said conveyor belt is a continuous web of metallic alloy strip.

3. The apparatus of claim 2, wherein said metallic alloy is a stainless steel.

4. The apparatus of claim 3, wherein said passive engagement means are formed integrally from the material of said continuous web.

5. The apparatus of claims 1 or 4, additionally comprising:

at least one loading station, adapted to engage contact elements of encapsulated electronic components with said passive engagement means in spaced succession from one-another; and at least one unloading station, adapted to disengage said contact elements from said passive engagement means.

6. The apparatus of claims 1 or 5, additionally comprising treatment means adapted to expose said encapsulated electronic components to treating fluids in their travel along the loop of said conveyor belt.

7. The apparatus of claim 6, wherein said treatment means includes at least one container along said conveyor belt provided with entrance an exit weirs and filled with a liquid treatment fluid.

8. The apparatus of claims 1 or 7, additionally comprising controller means to govern the operation of said drive means.

9. The apparatus of claim 8, wherein said controller means also govern the operation of said loading station.

10. The apparatus of claim 9, wherein said controller means energize said drive means to secure intermittent motion of said conveyor belt, and further govern the operation of said loading station so as to secure the engagement of said components with said passive engagement means during the stationary periods of the conveyor.

11. The apparatus of claims 1 or 10, wherein said passive engagement means include bevelling both faces of the linear edges of said conveyor belt.

12. The apparatus of claims 1 or 10, wherein said passive engagement means include uniformly spaced protrusions in the lateral edges of the web of said conveyor belt.

13. Improved apparatus for chemically treating the projecting contact elements of encapsulated electronic components and like devices, comprising:

a continuous, flexible conveyor belt of electrically conductive material;

guide means for said conveyor belt, constraining the motion thereof into a closed loop defined by a substantially vertical plane, with the web of said conveyor belt in substantially horizontal alignment;

passive engagement means defined by wedge-shaped edges of said conveyor belt, for the frictionally-secured reception of portions of said components thereon;

drive means for said conveyor belt; and at least work tank for liquid treatment a medium disposed along the path of said conveyor belt, said tank being provided with weirs in its upper edge adapted to pass the conveyor belt and components engaged thereon inwardly and outwardly of the liquid mass contained in said tank.

14. The apparatus of claim 13, wherein said passive engagement means are formed integrally from the material of said continuous web.

15. The apparatus of claim 13 or claim 14, additionally comprising at least one loading station, adapted to engage said elements with said passive engagement means; and at least one unloading station, adapted to disenage said elements from said passive engagement means.

* * * * *